United States Patent [19]

Schweikart

[11] 4,038,951

[45] Aug. 2, 1977

[54] DEVICE FOR LIMITING THE SPEED OF INTERNAL-COMBUSTION ENGINE

[75] Inventor: Horst Schweikart, Offenburg, Germany

[73] Assignee: Gehap Gesellschaft fur Handel und Patentverwertung mbH & Co. KG, Sasbachwalden, Germany

[21] Appl. No.: 614,819

[22] Filed: Sept. 18, 1975

Related U.S. Application Data

[63] Continuation-in-part of Ser. No. 414,591, Nov. 9, 1973, abandoned.

[30] Foreign Application Priority Data

Nov. 9, 1972 Germany ..... 2254811

[51] Int. Cl.[2] ..... F02D 11/10

[52] U.S. Cl. ..... 123/102; 123/148 CC; 123/149 C

[58] Field of Search ..... 123/102, 118, 148 CC, 123/149 C

[56] References Cited

U.S. PATENT DOCUMENTS

| | | | |
|---|---|---|---|
| 3,042,836 | 7/1962 | Hamilton et al. | 123/102 |
| 3,500,809 | 3/1970 | Hohne | 123/148 |
| 3,612,023 | 10/1971 | Sohner et al. | 123/148 CC |
| 3,661,132 | 5/1972 | Farr | 123/148 CC |
| 3,809,044 | 5/1974 | Jereb et al. | 123/148 CC |
| 3,863,616 | 2/1975 | Wood | 123/148 CC |
| 3,880,133 | 4/1975 | Katsumata | 123/148 CC |
| Re. 27,704 | 7/1973 | Carmichael et al. | 123/148 CC |

*Primary Examiner*—Carroll B. Dority, Jr.

*Assistant Examiner*—Paul Devinsky

*Attorney, Agent, or Firm*—Allison C. Collard

[57] ABSTRACT

Device for limiting the speed of internal-combustion engines, particularly suitable for small and medium-size, two-stroke engines which operate at rather high revolutions, such as between 2,000 and 10,000 rpm. Two exemplary embodiments are disclosed. In both, an ignition coil receives a discharge voltage from a capacitor energized by a charging coil, a rectifier being coupled to the output of the charging coil, and a separate tripping coil used in the circuit arrangement, which latter is displaced in phase with respect to the charging coil. A semiconductor switch, preferably a thyristor with steep electrical characteristics, is connected to the capacitor and has its switching gate connected to the tripping coil, the conductive phase of the switch being so controlled by the tripping coil that the charging process of the capacitor is at least partly inhibited when a predetermined maximum engine speed is attained or exceeded. This embodiment is equipped with a full-wave rectifier between the charging coil and the capacitor, and preferably has an adjustable resistor for controlling the required pre-ignition values. In the improved embodiment of the device, a limiting control coil is also provided, with a winding connected opposite to that of the tripping coil, but parallel therewith, preferably both in series with individual diodes. The angular phase displacement of the tripping and/or the limiting control coils is preferably set around 180°, with respect to the charging coil, which is most advantageous for achieving the required pre-ignition values.

7 Claims, 10 Drawing Figures

*Fig. 1*

DEVICE FOR LIMITING THE SPEED OF INTERNAL-COMBUSTION ENGINE

This is a continuation-in-part of the same applicant's patent application Ser. No. 414,591 filed Nov. 9, 1973, titled "Method and Apparatus for Limiting the Speed of Internal Combustion Engines", now abandoned.

This invention relates to a device for limiting the speed of internal-combustion engines, and specifically, to a special switching arrangement forming part of the device.

It is of great importance to limit the speed of internal-combustion engines as a function of their load, in order to extend the life of the engines. Generally, the speed of the engine is read from a speedometer or tachometer connected to the engine so that it can be manually or automatically throttled before reaching the maximum allowable speed. In this respect there are known devices that deliver an optical or acoustical signal when the maximum allowable speed is reached to permit the operator to cut back on the throttle.

This well known arrangement does not operate automatically, and to a large extent, is dependent on the attention of the motor operator. Automatic speed limiting arrangements are also relatively complicated in their designs since they must first ascertain the speed of the engine before throttling the same via appropriate control devices.

An object of the present invention is to avoid the drawbacks of the known devices, by starting from a completely different principle to determine the speed of the engine. It was found that the ignition of a spark plug, by the controlled discharge of a charged capacitor, depends on the engine speed. The release of the capacitor discharge can be controlled by an electrical element such as a thyristor. By appropriately monitoring these values, the ignition can be controlled when the maximum allowable speed is reached.

To solve the problem of the speed limitation of internal-combustion engines, the ignition is provided by the controlled discharge of a capacitor, charged from a charging coil via a rectifier. Tripping pulses, generated in a tripping coil, are fed to the gate of a thyristor which is connected in an ignition circuit consisting of a spark gap in a spark plug and an ignition capacitor. These pulses cause the thyristor to conduct while the capacitor discharges.

By switching suitable electrical means into the tripping circuit, e.g. by the appropriate selection of a resistor switched in parallel to the coil, a steep, speed-dependent voltage rise of the tripping pulses is generated. From a desired speed, the voltage rise of the tripping pulse will, in due time, fall in the charging sequence of the capacitor, so that the thyristor will remain switched below the maximum desired speed. The normal discharge for the ignition via the spark gap will thus only occur at a speed below the desired maximum speed value.

According to major features of the invention, that cover both exemplary embodiments that will be described hereinafter, the inventive device for limiting the speed of an internal-combustion engine comprises a rotatable member connected with a shaft of the engine; a single rotatable magnet system associated with a stationary core disposed with its outer front face adjacent the outer periphery of the rotatable member, so that the magnet system revolves in close proximity along that outer front face; a charging coil mounted about the core of the magnet system, for producing an electric pulse for each rotation of the rotatable member; rectifier means connected in part to the output of the charging coil, for rectifying the pulse; the capacitor being coupled between the ouput of at least a portion of the rectifier means and the primary winding of an ignition coil associated with the engine; a single stationary tripping coil mounted about a core in close proximity along the rotatable member and displaced in phase by an adjustable angular position with respect to the charging coil; a semiconductor switch connected between the rectifier means output and the input of the capacitor, and having its input gate coupled to the tripping coil; and a resistor connected substantially parallel to the tripping coil.

The angular position of the tripping coil is pre-set between predetermined limits between the two cores, to satisfy a permissible maximum speed value of the engine. The semiconductor switch is responsive to a pulse from the tripping coil and inhibits the capacitor from being fully charged from the rectifier means, to limit the discharge voltage from the capacitor to the primary winding, and thereby to limit the engine to the maximum speed value.

The value of the resistor is correlated to the maximum speed value, to the characteristics of the magnet system, and to the angular position of the tripping coil with respect to the charging coil. As a result, normal discharge for ignition is initiated for a spark plug of the engine when the engine rotation is below the maximum speed value, on the one hand, but the voltage build-up time of the tripping pulse arrives during the charging process of the capacitor, the switch thus remaining conductive, thereby inhibiting the capacitor from being fully charged when, on the other hand, the maximum speed value is attained or exceeded.

With the inventive device, the speed can be limited to a maximum without using speedometer devices, since with capacitor ignition, an otherwise ignored electrical quantity, which is speed-dependent, can be utilized in a simple manner to limit the ignition, and thus the speed of the engine.

In the just described first embodiment of the inventive device, the tripping coil is preferably disposed at an angle of about 173° with respect to the charging coil, its ohmic resistance having a value of about 60 ohms, which results in a speed limitation of the engines involved to about 8,000 rpm.

This arrangement operates satisfactorily for the desired speed limitation under certain constant conditions. It has however been found in practice that it has certain disadvantages that relate mainly to a certain lack of stability against influences of temperature, and to a requirement of choosing selected thyristors and resistors having particular, relatively stringent characteristics.

It is therefore a further object of the invention to provide an improved device, structurally supplemented but well within the basic original concept and arrangement, with which the desired speed limitation is achieved under extreme temperature differences and by using any commercially available thyristor and/or resistor (subject of course to the required electrical characteristics, but without being particularly selected), with the same or with even better results.

It is yet another object to avoid the drawbacks and disadvantages of the own earlier development, and to enlarge the scope of application of the device so as to cover a wider range of engine speeds, preferably between 2,000 and 10,000 rpm, as used nowadays in small and medium-size, two-stroke engines that operate at relatively high revolutions.

According to additional features of the second embodiment to be described later, the inventive device comprises a stationary limiting control coil that is connected substantially parallel to the tripping coil but with its winding in a direction opposite to that of the tripping coil, mounted about a core in close proximity to the rotatable member, and also being displaced in phase by an adjustable angular position so as to succeed the tripping coil during the rotation of the single magnet system.

Additional, optional features of the inventive device are constituted by the earlier-mentioned range for the adjustment of the tripping coil in a range of about 170° to 180°, pre-set to be dependent upon the engine rotation, upon the electrical value of the resistor, as well as upon the characteristics of the single magnetic system.

In the basic embodiment it has been found advantageous to connect a Zener diode in parallel to the resistor. The latter can be made adjustable, thereby eliminating the need of careful pre-selection of an appropriate value, and allowing adjustments without making changes in the circuit arrangement.

In the first embodiment, the resistor means is a full-wave rectifier connected between the output of the charging coil and a common point between the capacitor and the semiconductor switch.

Alternatively, the second embodiment may include individual rectifiers in the form of diodes, namely one between the charging-coil output and the above-explained common point, and two more between respective outputs of the tripping and the limiting control coils and the input gate of the semiconductor switch; preferably one end of the resistor is also connected to the input gate (the latter detail in both embodiments).

In both embodiments, the circuit arrangement may include a common ground connection between terminals of the primary winding of the induction coil, the charging coil, the tripping coil, the semiconductor switch and the resistor. In the first embodiment, the full-wave rectifier also has one of its DC poles brought to this common ground; while in the second embodiment, the end of the limiting control coil is also at ground, noting however that both the charging and the tripping coils have their starting terminals at ground, as explained earlier. The secondaries of the induction coils are preferably also at ground potential.

Turning now entirely to the improved, second embodiment, it is recommended that a stationary plate member be provided within the single magnet system, for radially carrying both the tripping and the limiting control coils in their respective adjustable angular positions. Respective pole plates can be used, adjoining the coil cores, the magnet system rotating about the pole plates by a narrow circumferential space that defines a uniform air gap.

Finally, the invention preferably uses in the second embodiment cores of an open, rod-shaped structure, the pole plate associated with the tripping coil being wider than that of the (additional) limiting control coil.

The second embodiment of the inventive device has the important advantage that the engine speeds can be increased at will or limited already in the lower speed range, namely by choosing an appropriate angular position for the limiting control coil. In these respects the time elapsing from the zero value of the limiting voltage is decisive up to the rise of the tripping voltage. With an increasing speed, in a manner similar to that explained earlier, the voltage increases from zero until it reaches the switching threshold of the thyristor so that the latter remains conductive. If this point coincides with or falls within the charging process, the charging current is bypassed as it were through the thyristor path so that the capacitor cannot store any energy, or only a small part thereof.

Consequently, when the next tripping pulse arrives at the required ignition time, no high voltage is produced because up to just then the capacitor was not or was only insufficiently charged. If ignition is skipped, the engine immediately drops in its speed, which however results in an immediate resumption of ignition because the limiting voltage drops. The hysteresis is neglibible and unnoticeable in a running engine.

The angular direction of the limiting coil has to be carefully observed because otherwise premature speed limitation might result in engines running at high speeds, which would only lead to higher speeds on account of the excessive angular displacement of the limiting control coil.

The novel devices according to the invention are explained by way of two preferred examples of a switching or circuit arrangement, as shown in the attached drawings, wherein similar reference characters denote similar elements throughout the several views.

Figure 1:
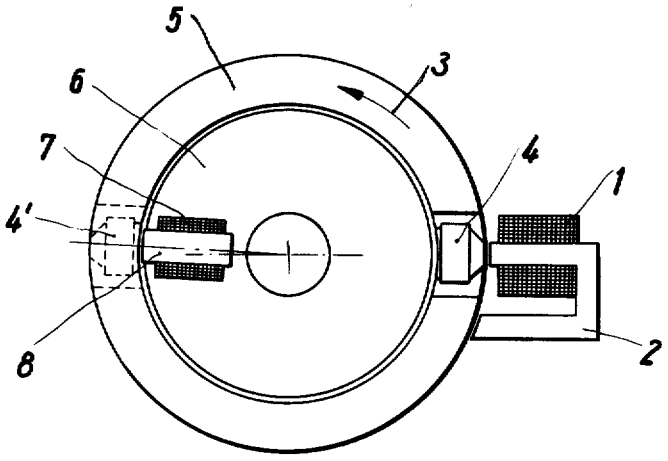
FIG. 1 is a somewhat schematic view of a first exemplary embodiment of the ignition device according to the invention for internal-combustion engines, showing the spatial coordination of a magnetic system to a charging coil and a tripping coil.

In FIG. 1, an ignition device for an internal-combustion engine consists of a charging coil 1 which is arranged on an iron core 2. Pole shoes of the iron core are arranged on a permanent magnetic system 4 which is rotated in the direction of arrow 3. As the poles of the system 4 pass the pole shoes of the core 2, a voltage with a specific pulse form is induced in the coil 1. The magnetic system 4 is located in a protruding rim 5 of a rotating disc which is driven by the engine, parts of which are not illustrated. The number of revolutions of the disc corresponds to the speed of the engine.

A single-pole control or tripping coil 7 with an iron core 8 is arranged in a central, stationary member 6. The coil 7 points radially outward, and is preferably arranged at a phase angle alpha = 180° with respect to the charging coil 1. The permanent magnet 4, which initially travels past the coil 1, generates a charging pulse in that coil. When the system 4 rotates to a position 4', a peak pulse is generated in the tripping coil 7.

Figure 2:
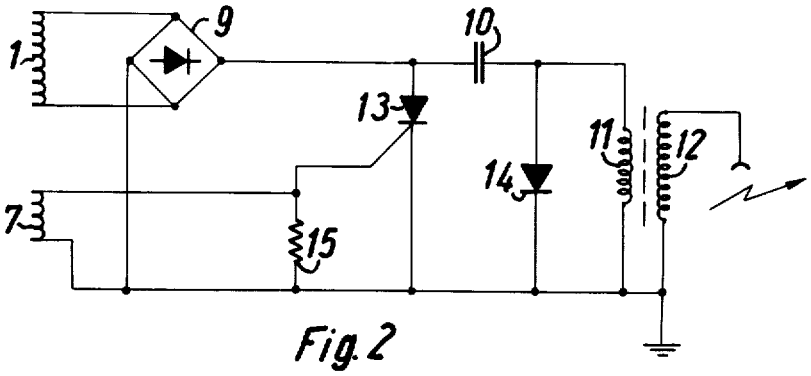
FIG. 2 shows the circuit diagram of the switching arrangement of the device of FIG. 1.

In the switching arrangement according to FIG. 2, the charging coil 1 is connected to a full-wave rectifier 9, the output of which is connected across one pole of a charging capacitor 10 and ground, as shown. The capacitor is further connected to a primary winding 11 of an ignition coil. A secondary winding 12 is connected to a spark plug schematically indicated at 17. The output of the rectifier 9 to the capacitor 10 is also connected to a thyristor 13 which leads to the ground and is thus at the other end of the primary winding 11. The control electrode of the thyristor 13 is connected to one terminal of the tripping coil 7. A diode 14 is connected in parallel to the primary winding 11.

Figure 3:
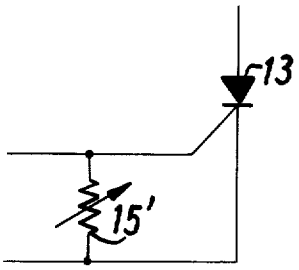
FIG. 3 is a detail view of a modified circuit of FIG. 2.

A resistor 15 is connected in parallel to the tripping coil 7. This resistor can be a fixed resistor, the value of which is determined in advance according to the requirements, or it may also be an adjustable resistor, as can be seen in FIG. 3 where the modification includes a potentiometer or adjustable resistor 15', which can be set during operation to the desired permissible maximum speed of the engine.

Figure 4:
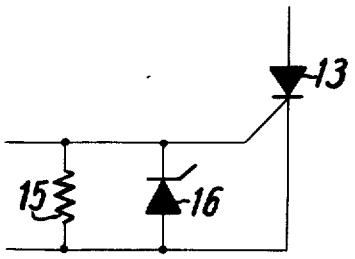
FIG. 4 is a further detail of FIG. 2, of another modified circuit.

As can be seen from FIG. 4, a Zener diode 16 can, in addition, be connected in parallel to the resistor 15 (or to the adjustable resistor 15', as the case may be). The Zener diode serves to produce an absolute limitation to a specific speed. Indeed, as the Zener diode 16 reaches its voltage value, it becomes conductive and the voltage is then limited to the value of this Zener diode. This indirectly ensures that the performance of the engine is limited by the Zener diode.

The function of the above-described first embodiment of the inventive device is as follows, which however basically applies to the second as well, as will be seen later: after the engine shaft starts and initially rotates, the ring 5 according to FIG. 1, connected thereto, rotates with the engine shaft. In so doing, the magnetic system 4 is moved past the pole shoes of the core 2 of the charging coil 1, to generate a voltage pulse. This pulse is rectified by the recitifier 9, i.e. the positive as well as the negative part of the pulse are utilized to generate the storage energy. The rectified voltage is fed to the capacitor 10 which is being charged to a corresponding value. The diode 14 prevents the charging current from closing via the primary winding 11 of the ignition coil.

When the capacitor 10 is charged and the magnetic system 4 continues to move in the course of the rotation, the latter arrives within the range of the control or tripping coil 7 which is arranged in the inner stationary part 6 at a specific angle, in the present case at an angle of 180°, namely to the charging coil 1.

The magnetic system 4 then reaches its position 4' and induces in the tripping coil 7 a voltage pulse that is fed to the control electrode of the thyristor 13, and which now introduces the charge of the capacitor 10 via the primary winding 11. This function is illustrated by the voltage-current relations of FIGS. 5 and 6.

Figure 5:
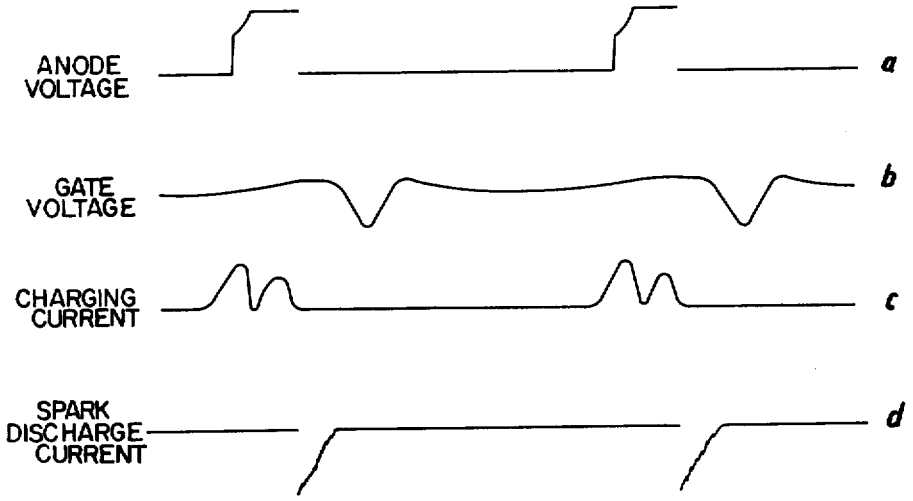
FIG. 5 is a diagram of the individual voltages and currents in the normal course of ignition.

As can be seen from FIG. 5, a pulse form *a* shows the course of the anode voltage of the thyristor 13. A pulse form *b* shows the course of the gate voltage which, as compared to the anode voltage, is displaced in time. A curve *c* shows the course of the charging current at the capacitor 10, and a pulse form *d* represents the discharge current. With normal ignition, this latter is so large that correct ignition will occur over the spark gap of the spark plug 17.

As the engine speed increases, the rise time of the tripping pulse from the coil 7 becomes steeper and the thyristor 13 is ignited sooner by this time reduction. The rise of the tripping or gate voltage is now heavily dependent on speed, i.e. the higher the speed, the steeper the rise of the tripping voltage.

By means of the resistor 15 coupled in parallel to the tripping coil 7, the tripping voltage can now be influenced in such a manner that sooner or later it will reach, in the desired manner, the ignition point of the thyristor 13. In this process, by selecting an appropriate value of the resistor 15, the rise of the gate voltage can be made so steep that the pulse peak of this gate voltage will shift in the direction of the charging current.

The voltage rise can fall in due time in the charging sequence so that the thyristor 13 remains switched on during the charging sequence, whereas the capacitor 10 will not charge. The charging voltage at the capacitor is thus already destroyed with its first half wave over the open path of the thyristor 13. Thus the capacitor will not have a sufficient charging voltage to cause ignition by discharge via the primary winding 11 of the ignition coil. Consequently, in the further sequence, only the second half wave remains available at the capacitor for the ignition process. Thus the capacitor 10 will only be charged with a half wave. This charging energy will be insufficient to attain an ignition voltage at the secondary winding 12 of the ignition coil.

Figure 6:
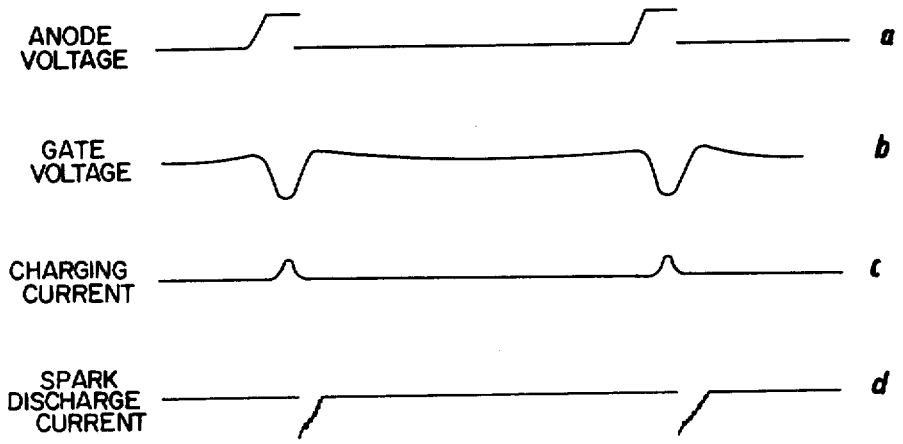
FIG. 6 is a similar diagram with speed limitation.

As can be seen from FIG. 6, the rise of the tripping voltage with the pulse form *b* is steeper and coincides with the charging current *c* when charging the capacitor 10. Because of this, the anode voltage of the pulse form *a*, as well as the discharge current of the form *d*, are reduced to such an extent that no ignition occurs at the spark plug. It should again be recalled that these actions take place when the gate voltage, upon reaching a certain maximum, is so steep that a shift will coincide with the charging sequence of the capacitor 10. The gate voltage can be made as steep as desired by changing or adjusting the resistor 15 or 15' and thus be displaced in due time, so that with the selection of the resistor value, the preferred maximum speed can be fixed.

When the desired speed is reached, the above-described process brings about a speed reduction, until the timing agreement between the charging sequence and the tripping is re-established, as can be seen in FIG. 5.

In a modified embodiment of the arrangement according to FIGS. 1 through 6 of the invention, the tripping coil can be arranged at a phase angle of 173° to the charging coil. The resistance is taken in this case with 60 ohms, which results in a speed limitation of the engine to 8,000 rpm.

The switching arrangement that has been described so far is particularly suited for small engines with magnetic ignition, which are used on two-wheeled vehicles, chain saws, etc. It is of course also usable on larger engines that operate according to the same principle.

We are now coming to the description of the second, improved embodiment of the inventive device. The basic ignition device of the internal-combustion engine is similar to that already described, only the reference numbers have been selected from a higher (but coordinated) group. Thus, for example, a charging coil 21 is shown on an iron core 22, the magnetic system being identified by numeral 24, and will be described hereinafter on account of its differences from the system 4 of the first embodiment. The direction of rotation is shown by arrow 23. The mechanical structure is of course shown in FIG. 7 while the circuit arrangement appears in FIG. 8, in a manner similar to that of FIGS. 1 and 2. A charging capacitor 30, primary and secondary windings 31, 32 of an ignition coil, a thyristor 33, a diode 34, a resistor 35, and a spark plug connection 37 are all shown substantially as in the first embodiment.

In this device, three individual rectifier diodes are used, namely a diode 29*a* in series with the charging coil 21, another diode 29*b* in series with a tripping coil 27 (also to be explained on account of its different mechanical arrangement), and a third diode 29*c* which is in series connection with a limiting control coil 47, characteristic of and additional to the improved embodiment. The electrical connections can be seen in FIG. 8, the connection of the diode 29*a* being similar to that of the rectifier 9 in FIG. 2, while both diodes 29*b*, -*c* lead to a common point that is also connected to the gate of the thyristor 33. Consequently the limiting control coil 47 with its diode 29*c* is substantially parallel connected with the tripping coil 27 ahd its diode 29*b*, but with its winding running in the opposite direction, as shown by the arrows (which at the same time identify the usual cores of the coils).

Figure 8:
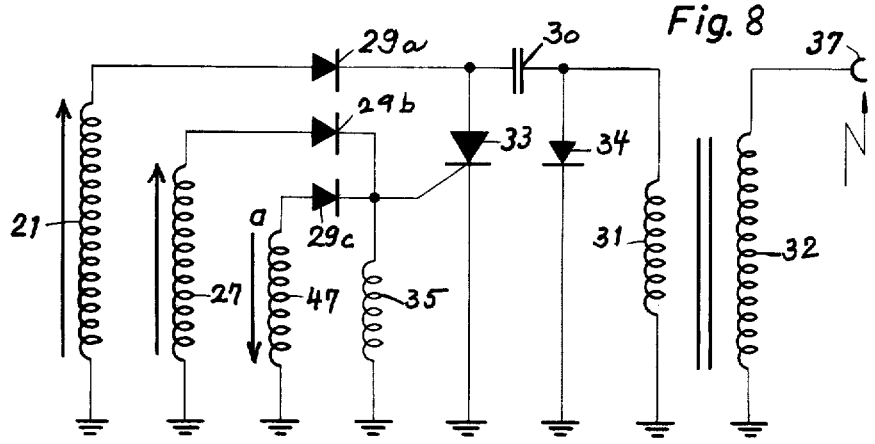
FIG. 8 shows the circuit diagram of the switching arrangement of the device of FIG. 7.

The resistor 35 shown in FIG. 8 can also be made in the form of an adjustable resistor, as was shown in FIG. 3, to allow adjustment without replacing this component. An appropriate resistor value can be chosen for the fixed component, or adjusted on a potentiometer, if used in the circuit of FIG. 8, to suit the predetermined engine speed range that should be maintained or observed.

Figure 7:
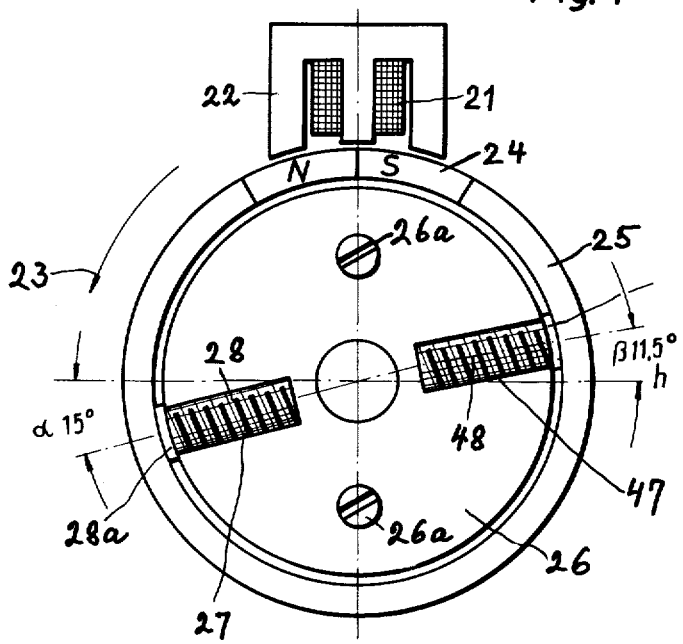
FIG. 7 is a somewhat schematic view of a second exemplary embodiment of the device according to the invention, showing also a limiting control coil, in addition to the charging and tripping coils.

The charging coil 21 is disposed on the core 22 as can be seen in FIG. 7. The poles of the core are closely adjacent to the outer periphery of the magnet system 24, which can be made in the form of a fan wheel 25 and the like (only schematically shown), rotated in the direction of the arrow 23, namely by the earlier-explained engine shaft (not shown). As has earlier been explained, a voltage with a particular pulse shape is being induced in the coil 21 as the magnet 24 (identified with the customary pole designations N and S) rotates past the poles of the core 22. It will be understood that the speed of the wheel 25 corresponds to that of the engine.

A centrally disposed stationary disc 26 may be attached to the structure of the engine by means of screws 26*a* or some similar expedient. The tripping coil 27 is supported by this disc in a radial direction, and so is the limiting control coil 47. These coils are preferably provided with open cores 28, 48, respectively, which have pole plates 28*a*, 48*a*, shown. An appropriate air gap is left for the wheel 25 or the magnet system 24 as it rotates about these elements. The angle alpha formed by the axis of the tripping coil 27 with respect to an imaginary horizontal axis *h* is about 17° (shown in the drawing as 15°, being a particular exemplary value), although of course other specific angular values can also be chosen.

While cores 28, 48 are open, and preferably rod-shaped, the pole plate 28*a* of the tripping coil 27 may be made somewhat wider than the pole plate 48*a* associated with the limiting coil 47. The diameter of the plate 28*a* influences the ignition timing while that of the plate 48*a* contributes to the speed limitation.

The angle beta, again as compared to the horizontal axis, by which the coil 47 is fixed, amounts to 13°, ± 5 10° to allow adjustments. The means for making the angular adjustments are not shown but will be understood by the self-explanatory to those skilled in the art.

The operation of the improved second embodiment is similar to that already described for the first embodiment, but with the following additional remarks to be observed.

The pulse induced in the coil 21 is rectified by diode 29*a* and then used for generating the storage energy for the capacitor 30. The diode 34 prevents leakage through the primary coil 31, as was explained earlier. The charging voltage course can be seen in FIG. 9 by the curve $I_1$.

Figure 9:
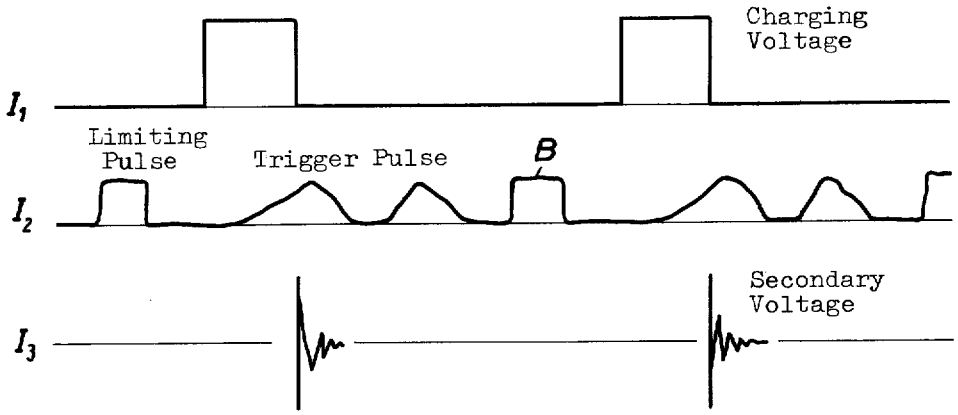
FIG. 9 is a diagram of the various pulses in the normal course of ignition.

Once the capacitor 30 is charged, the magnet system has moved in the interim to the region of the tripping coil 27, which is at an angle of about 195° to 197° from the charging point. The resulting tripping or trigger pulse is shown in FIG. 9 at $I_2$, which pulse is led from the coil 27 through the 29*b* to the gate of the thyristor 33. The conductive thyristor switch discharges the capacitor 30 through the primary 31, causing a secondary voltage to be generated as shown in the same figure at $I_3$, of course in the secondary winding 32 of the induction coil, which leads to the spark plug 37.

As the magnet system 24 continues rotating, it reaches the pole plate 48*a* of the limiting control coil 47, where a limiting pulse is induced, as shown in the curve $I_2$. The legend is applied on the left-hand side, while the same pulse is also identified by the letter B, further to the right-hand side.

In the normal course of ignition (as illustrated in FIG. 9) this limiting pulse B has no effect on the charging voltage because the pulse curve drops to zero before the capacitor 30 is charged again. The thyristor 33 is not made conductive, and the capacitor can be charged again. The next tripping pulse initiates the next discharge, resulting in the earlier-explained course $I_3$ of the resulting secondary voltage.

Figure 10:
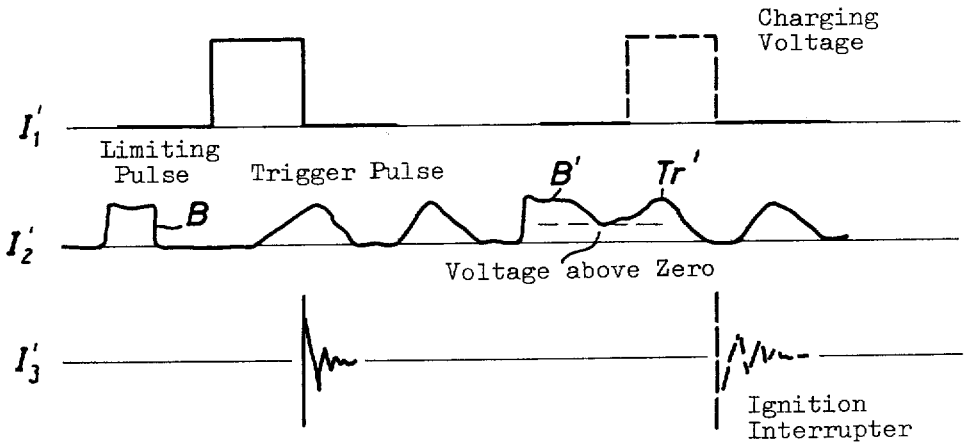
FIG. 10 is a similar diagram with speed limitation, both FIGS. 9 and 10 relating of course to the embodiment of FIGS. 7 and 8.

Coming now to FIG. 10, we can explain the effects of the speed limitation obtained by the inventive device. When speed increases, the voltage of the next and subsequent tripping pulse(s) goes so far above zero that there cannot be a drop of reduction to zero any more between a subsequent tripping pulse Tr′ and a limiting Pulse B′, as can readily be seen from curve $I_2'$. The voltage above zero is shown with a horizontal broken line (underneath the B′ and Tr′ designations).

As a result, a sufficiently high voltage appears at the thyristor gate so that the same is made conductive during the entire process. If this point coincides with the charging or igniting moment, then the charging current is leaked directly by way of the thyristor 33 while the capacitor 30 cannot be charged. This is visualized in the right-hand part of a curve $I_1'$ in FIG. 10 by the broken-line peak identified by "Charging Voltage", which does not take place at this instant (as it did further to the left-hand side, earlier in the curve).

As a result, curve $I_3'$ includes a similar broken-line indication of an "Ignition Interrupter" effect, that is a phase without any high-voltage generation, or in other words, an absence of a spark discharge in the engine.

Immediately upon the ignition havine been skipped or suppressed, the engine speed drops, resulting in turn in the re-establishment of ignition as soon as the speed resumes a value below the predetermined maximum, so as to follow the curves of FIG. 9. It should be noted that the hysteresis of this process is negligibly small and hardly noticeable on the engine operation.

It has been observed that the angular setting of the limiting control coil 47 has to be carefully maintained because, with high-speed engines, premature speed limitation may occur, which would only lead to even higher speeds on account of an increased angular deviation of the control coil. The angular orientation of the tripping coil 27 in respect of the charging moment is decisive for a course pre-ignition setting. Similarly the resistor 35 influences both the ignition setting and the speed limitation. It is also responsible for the angular adjustment or setting of the tripping coil and of the limiting control coil. If the resistor value is increased, the ignition adjustment is increased, while the speed limitation (that is the permissible maximum speed) drops.

The earlier-explained diametral ratio of the pole plates 28*a*, 48*a* is also important for the proper operation of the inventive device, insofar that the diameter of the plate 28*a* has to be greater than that of 48*a*. The width or diameter adjustment of these plates is another measure for making appropriate adjustments: the plate 28*a* of the tripping coil 27 influences the ignition setting, while the plate 48*a* of the limiting control coil 47 has an effect on the speed regulation proper.

The explained angular settings of the coil axes from the horizontal, also as shown in FIG. 7, are optimum values, which have been worked out for average-type small engines of the type generally controlled by the inventive device, and particularly for a speed limitation up to 10,000 rpm.

It should be understood, of course, that the foregoing disclosure relates only to two exemplary, preferred embodiments of the novel device, and that is it intended to cover all changes and modifications of the examples described which do not constitute departures from the spirit and scope of the invention.

In particular, it should be noted that details shown for one embodiment can be used with the other, and vice versa, so far as they are electrically mechanically compatible.

What I claim is:

1. A device limiting the speed of an internal combustion engine having a shaft, an ignition coil including a primary winding (11, 31) and a secondary winding (12, 32), an engine spark plug (17, 37) connected with the secondary winding, and a charging capacitor (10, 30) connected in circuit with the primary winding for controlling the discharge of the capacitor to produce a controlled discharge voltage therefrom to controllably activate the spark plug, comprising:

a rotatable member (5, 25) connected with said shaft;

a single rotatable magnet system (4, 24) carried by said rotatable member for rotation therewith;

a stationary first core (2, 22) including a front face disposed adjacent to and in close proximity to the outer periphery of said rotatable member, a charging coil (1, 21) mounted about said core for producing an electric pulse for each rotation of said rotatable member;

a stationary second core (8, 28) mounted in close proximity to said rotatable member and displaced in phase from said stationary first core by an adjustable angular position relative to said charging coil, a single stationary triggering coil (7, 27) mounted about said second core, the position of said second core being present with respect to said first core to satisfy a predetermined maximum speed value of said engine;

rectifier means (9, 29*a*) coupled to said charging coil responsive to the electric pulse output therefrom for rectifying the pulse output, said capacitor having an input coupled to the output of said rectifying means;

a simi-conductor switch (13, 33) connected between said rectifier means output and said input of said capacitor, the input gate of said switch being coupled to said triggering coil and responsive to a pulse therefrom to inhibit said capacitor from being fully charged from a rectifier means and thereby limiting the discharge voltage from said capacitor to said primary winding, thereby limiting the engine to a maximum speed value;

a resistor (15, 35) connected parallel with said triggering coil, said resistor having a value correlated to the maximum speed value and the characteristics of said magnet system; and means adjusting the angular position of said triggering coil with respect to said charging coil to activate the spark plug when engine rotation is below said maximum speed value, said switch being responsive to said triggering coil to prevent full build up of charge on said capacitor in response to engine rotation at said maximum speed value thereby applying said pulse from a triggering coil to said switch while the output from said rectifier means is applied to said capacitor, said spark plug being prevented from being activated in response to less than full build up of charge on said capacitor when said maximum speed value is attained.

2. The device as defined in claim 1, wherein said angular position is adjustable in a range of about 170° to 180° and is pre-set dependent upon the rotation of the engine shaft, the value of said resistor (15, 35), and upon said characteristics of said single magnet system (4, 24).

3. The device as defined in claim 1, further comprising a Zener diode (16) connected parallel to said resistor (15).

4. The device as defined in claim 1, wherein said resistor is adjustable (15').

5. The device as defined in claim 1, further comprising a common ground connection between terminals of said primary winding (11), said charging coil (1), said rectifier means (9), said triggering coil (7), said semiconductor switch (13) and resistor (15).

6. The device as defined in claim 1, further comprising a stationary limiting control coil (47) connected substantially parallel to said triggering coil (27) but with a winding in a direction opposite to that of said triggering coil, mounted about core (48) in close proximity to said rotatable member (26), and displaced in phase by an adjustable angular position so as to follow said triggering coil during the rotation of said single magnet system (24).

7. The device as defined in claim 6, wherein said rectifier means includes individual diodes (29*a*) between said output of the charging coil (21) and a common point between said capacitor (30) and said semiconductor switch (33), and (29*b*, *c*) between the respective outputs of said triggering (27) and said limiting control coils (47) and said input gate of the semiconductor switch (33), one end of said resistor (35) being also connected to said input gate.

* * * * *